United States Patent [19]

Hudspeth et al.

[11] Patent Number: 4,890,118

[45] Date of Patent: Dec. 26, 1989

[54] COMPENSATED MICROWAVE FEED HORN

[75] Inventors: Thomas Hudspeth, Malibu; Fritz Steinberg, Culver City, both of Calif.

[73] Assignee: Hughes Aircraft Company, Los Angeles, Calif.

[21] Appl. No.: 289,881

[22] Filed: Dec. 27, 1988

[51] Int. Cl.[4] ..... H01Q 13/02

[52] U.S. Cl. ..... 343/786; 343/772; 333/21 A; 333/251

[58] Field of Search ..... 343/772, 783, 784, 786; 333/21 A, 21 R, 251

[56] References Cited

U.S. PATENT DOCUMENTS

| | | | |
|---|---|---|---|
| 3,573,838 | 4/1971 | Ajioka | 343/786 |
| 4,114,121 | 9/1978 | Barlow | 333/251 |
| 4,268,804 | 5/1981 | Spinner et al. | 333/251 |
| 4,712,110 | 12/1987 | Branigan et al. | 343/786 |

OTHER PUBLICATIONS

"A New Horn Antenna with Suppressed Sidelobes and Equal Beamwidths," by P. D. Potter, Microwave Journal, VO, VI, pp. 71–78, Jun. 1963.

"The Circular Waveguide Step-Discontinuity Mode Transducer," by W. J. English, IEEE Trans. Microwave Theory Tech., vol. MTT-21, pp. 633–636, Oct. 1973.

"Phase Characteristics of a Circularly Symmetric Dual-Mode Transducer," by K. K. Agarwal, IEEE Trans. Microwave Theory Tech., vol. MTT-18,, pp. 69–71, Jan. 1970.

"Fields and Waves in Modern Radio," by Simon Ramo and John R. Whinnery, published by John Wiley and Sons, and in particular at pp. 335–338.

*Primary Examiner*—Rolf Hille

*Assistant Examiner*—Doris J. Johnson

*Attorney, Agent, or Firm*—Steven M. Mitchell; Wanda Denson-Low

[57] ABSTRACT

A feed horn employing a novel compensator design which substantially reduces off-axis cross polarized components of circularly polarized energy over a wide range of angular directions. The compensator comprises a plurality of L-shaped compensating conductors disposed in a generally symmetrical fashion about a longitudinal axis of the feed horn. The conductors extend inwardly from the output aperture of the feed horn and then radially outwards a predetermined distance away from the axis toward the horn sidewall. The conductors are disposed at an angle relative to the axis, which angle is generally defined by an cone whose apex is the same as the apex of the feed horn. A nonconducting support structure supports the conductors within the feed horn. A dielectric matching member is disposed in the feed horn to eliminate unwanted energy reflections.

14 Claims, 1 Drawing Sheet

COMPENSATED MICROWAVE FEED HORN

BACKGROUND OF THE INVENTION

The present invention generally relates to microwave feed horns, and more particularly to a compensated microwave feed horn which reduces cross polarized components of circular polarized radiation emanating therefrom.

State of the art gigahertz antenna arrays for radar systems utilize one wavelength diameter feed horns. The diameter of such feed horns is approximately one inch. When driven at their input waveguide ports with circularly polarized energy, such feed horns generate far field radiation patterns which contain undesirable cross polarized, or opposite sense circularly polarized, components which vary in amplitude from negligible on axis to an undesirable level off axis.

Conventional Potter-type feed horns have operating characteristics which would provide for reduced cross polarization components in off axis directions. However, the Potter-type feed horns are typically larger aperture horns and such one wavelength diameter feed horns are difficult to optimize. A better understanding of Potter-type feed horns may be found from a reading of "A New Horn Antenna with Suppressed Sidelobes and Equal Beamwidths," by P. D. Potter, Microwave Journal, Vol. VI, pages 71–78, June 1963, "The Circular Waveguide Step-Discontinuity Mode Transducer," by W. J. English, IEEE Trans. Microwave Theory Tech., Vol. MTT-21, pages 633–636, October 1973, and "Phase Characteristics of a Circularly Symmetric Dual-Mode Transducer," by K. K. Agarwal, IEEE Trans. Microwve Theory Tech., Vol. MTT-18, pages 69–71, January 1970.

However, it has been found that by exciting a one inch diameter conventional feed horn with linearly polarized energy, the far field H plane and E plane radiation patterns have substantially equal magnitudes off axis at approximately 45 degrees, the axial ratio measurements using circularly polarized energy excitation indicate a phase difference off axis between E and H planes.

SUMMARY OF THE INVENTION

In order to overcome the amplitude and phase difference problems indicated above, the present invention provides for a compensated feed horn, and more particularly, a compensator for use in an antenna feed horn, which reduces off-axis cross polarized components of circular polarized radiation emanating therefrom when it is excited with circularly polarized energy.

The feed horn generally comprises a base having an input aperture and a conical horn portion extending from the base to an output aperture. The compensator portion comprises a plurality of L-shaped compensating conductors disposed symmetrically about a longitudinal axis of the feed horn and extending from its output aperture a predetermined distance toward the base and then radially outwards a predetermined distance away from the longitudinal axis of the feed horn toward its sidewall. The compensating conductors are disposed at a predetermined angle relative to the axis, which angle is defined by an imaginary cone whose apex is the same as the apex of the conical horn portion.

A nonconducting support structure is attached to the feed horn and to the plurality of compensating conductors for supporting the conductors within the feed horn.

A dielectric member having an aperture of predetermined size is disposed between the base and the compensating conductors for eliminating unwanted energy reflection caused by the compensating conductors and the support structure.

The present invention substantially reduces the cross polarized component of circularly polarized energy over a wide range of directons, typically up to about forty degrees off axis. Indeed, test results show an improvement in off-axis circular polarization for single horns and for a secondary pattern for an array of feed horns illuminating a parabolic reflector.

BRIEF DESCRIPTION OF THE DRAWING

The various features and advantages of the present invention may be more readily understood with reference to the following detailed description taken in conjunction with the accompanying drawing, wherein like reference numerals designate like structural elements, and in which.

DETAILED DESCRIPTION

Figure 1A:
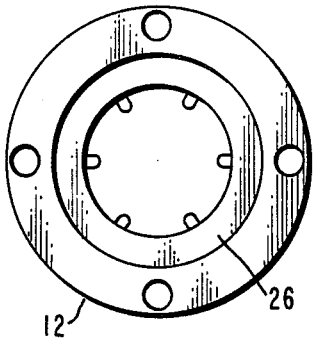
FIGS. 1*a–c* illustrate three views of an embodiment of a compensated feed horn in accordance with the present invention.
Figure 1B:
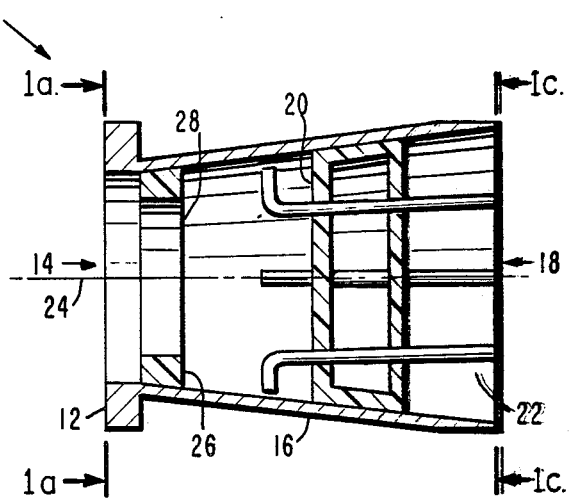
Figure 1C:
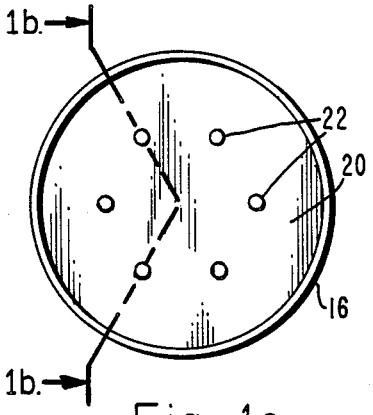

Referring to FIGS. 1*a–c*, back, cutaway side and front views of a compensated feed horn 10 in accordance with the present invention are shown. The feed horn 10 includes a base 12 having an input aperture 14, and a conical horn portion 16 which tapers to an output aperture 18. In the disclosed embodiment, the feed horn 10 has a circular cross section. However, the feed horn cross section may be any appropriate cross section other than circular.

A hollow support member 20 is disposed within the feed horn 10 and is adapted to secure and support a plurality of L-shaped compensating conductors 22 within the feed horn 10. The hollow support member 20 may be any dielectric material, but is generally chosen to have low loss and a low dielectric constant. A suitable material for use in constructing the support member 20 is a product known as ULTEM 1000, sold by General Electric Company, although this material has a dielectric constant of about 3.1, which might not be suitable for all applications. However, the ULTEM 1000 material is suitable for high ambient temperature applications. The plurality of conductors 22 are symmetrically arranged in a conical fashion as will be more fully discussed below.

The final component of the compensated feed horn 10 is a matching member 26 having an aperture disposed therein which is disposed between the base 12 and the support member 20. The matching member is generally a dielectric material, such as a cross linked polystyrene material, or the like, manufactured by the Polymer Corporation, sold as catalog item Q200.5, or Emerson Cummings Corporation, sold under the trade name Stycast, and generally known in the art as Rexolite.

The plurality of L-shaped compensating conductors 22 may be comprised of metal wire, such as copper, or tin-copper, or the like, which may be plated with silver, or the like, to reduce energy loss during operation. The plurality of compensating conductors like along an imaginary cone whose apex generally coincides with the apex of a cone that defines the sidewall of the horn portion 16. The positions of the conductors and the cone angle were initially determined based on empirical data. The cone angle is such that its radius is chosen at a point where there are no radial components of the E field pattern for the $TM_{11}$ mode. The corresponding transverse E field pattern has a shape which resembles the $TM_{11}$ mode shown in FIG. 2.

The radius at which the conductors are positioned may also be calculated using the expressions for transverse magnetic waves in a circular guide:

$$E_r = H_\phi Z_{TM}$$

$$E_Z = AJ_n(k_c r)\begin{cases}\cos n\phi \\ \sin n\phi\end{cases}$$

$$H_\phi = -j\frac{f}{f_c\eta_1}AJ_n'(k_c r)\begin{cases}\cos n\phi \\ \sin n\phi\end{cases}$$

One boundary condition is satisfied where the axial E field, which is proportional to $J_1(k_c a)$, is zero, where a is the radius of the inside of the feed horn wall. This allows a determination of the value of $k_c$. The equation $J_1(k_c a)=0$ is solved for $k_c a$, which has a root, other than at zero, at 3.832. The location of the nodes where the radial component is equal to zero where $J_1'(k_c r)=0$. Thus, $J_r'(k_c r)$ has a root, other than at zero, at $k_c r=1.841$. Therefore, the distance r at which the conductors are located from the longitudinal axis of the feed horn is determined from the ratio $k_c r \div k_c a = r \div a = 1.841 \div 3.832 = 0.480$. Therefore, the desired position of the conductors at a particular point in the feed horn is 0.480 times the radius of the wall at that particular point.

The above expressions are generally well-known in the art, by may be more readily understood with reference to the book entitled "Fields and Waves in Modern Radio," by Simon Ramo and John R. Whinnery, published by John Wiley and Sons, and in particular at pages 335–338.

The number of conductors, and the lengths of each arm of the L were chosen empirically to arrive at a configuration in which there are no variations of the distant field where the feed horn 10 is rotated. This implies that the observed far field is constant, or invariant, with respect to amplitude and phase. It appears that at least six symmetrically disposed conductors are required to achieve a constant field when the feed horn 10 is rotated about its longitudinal axis. When four conductors were employed, test results indicated that there was a variation in the remote field when the feed horn 10 was rotated about its longitudinal axis.

The conductors 22, which are coupled to its $TE_{11}$ wavelength mode by their radial portion, carry currents which result in a donut like remote field pattern. This field adds to the field produced by the $TE_{11}$ mode in the feed horn 10 to produce the desired corrected pattern.

Figure 2:
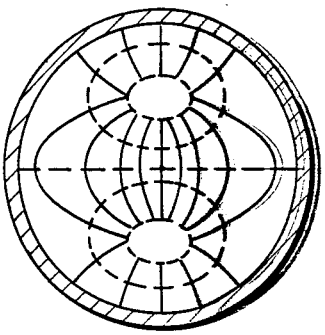
FIG. 2 illustrates the correcting field distribution in cross-sectional plane which is present at the output aperture of the feed horn.

The long portions of the L-shaped conductors are perpendicular to the electric field of the $TE_{11}$ mode. This avoids interaction with the $TE_{11}$ mode except where the conductors 22 project radially. In this region the conductors 22 interact with $TE_{11}$ modes to produce TEM waves which resemble a $TM_{11}$ wave in the feed horn 10, and supplant it. The resultant transverse field distribution at the output aperture 18 resembles that produced by the $TM_{11}$ mode which creates the desired radiated pattern. Reference is made to FIG. 2 which shows the field distribution in cross-sectional plane, at the plane of maximum transverse fields, which is present at the output aperture of the feed horn 10. The locations of the ends of the conductors are disposed at a radius which is located at the center of the two nodes shown in FIG. 2. The conductors 22 are shown as extending to the plane of the output aperture of the feed horn 10, but this is not to imply that this is a limitation. However, the lengths of the conductors 22 may be such that they protrude from or are slightly inside the feed-horn 10. Specifically, the lengths of the conductors 22 may be adjusted in order to fine tune the radiation pattern.

It has been found that the azimuth radiation pattern of the feed horn 10 using four conductors 22 has four maxima. However, six conductors 22 eliminate any detectable variation. The length of each leg of each L-shaped conductor 22 is determined to produce the necessary amplitude and phase in the radiated energy pattern. The position of the support member 20 along the axis is chosen to make reflections from its front and back faces cancel in the transmission band. The dielectric matching member 26 tunes out the remaining mismatch due to the conductors 22. The resulting return loss in the transmission band of 11.938 gigahertz to 12.105 gigahertz is better than 24 dB, and in the receiving band of 17.371 gigahertz to 17.705 gigahertz, the return loss is better than 18 dB.

A compensated feed horn having the following relevant component dimension was built and tested and achieved the above-cited performance: horn length: 1.30 inches; horn wall thickness: 0.040 inches; input aperture: 0.69 inches; output aperture: 0.982 inches; compensating conductors: long arm: 0.86 inches, short arm 0.19 inches; conductor diameter: 0.05 inches; the ends of the conductors were disposed on a circle having a diameter of 0.471 inches at the output aperture; matching member: 0.125 inches thick with its aperture having an internal diameter of 0.525 inches and an external diameter at its center of 0.730 inches in diameter, tapering to match the feed horn taper; and support member thickness dimension: 0.33 inches.

Thus there has been described a new and improved compensated microwave feed horn which reduces cross polarized components of circular polarized radiation emanating therefrom. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A compensator for use in a microwave feed horn comprising a base having an input aperture and a conical horn portion extending from the base to an output aperture, which compensator reduces off-axis cross polarized components of circular polarized radiation emanating from the feed horn, said compensator comprising:

a plurality of L-shaped compensating conductors disposed symmetrically about a longitudinal axis of the feed horn and extending inwardly from its output aperture a predetermined distance toward the base and then radially outwards a predetermined distance away from the axis, and disposed at a predetermined angle relative to the axis;

a nonconducting support structure attached to the feed horn and to the plurality of compensating conductors for supporting the conductors within the feed horn; and a matching member having a circular aperture of predetermined size disposed between the base and the compensating conductors for eliminating unwanted reflections created by the compensating conductors.

2. The compensator of claim 1 wherein said nonconducting support structure comprises a plastic support structure.

3. The compensator of claim 1 wherein said matching member comprises a dielectric matching ring.

4. The compensator of claim 2 wherein said matching member comprises a dielectric matching ring.

5. A compensated microwave feed horn which reduces cross polarized components of circular polarized radiation emanating therefrom, said feed horn comprising:

a circular base comprising an input aperture having a predetermined diameter disposed therein for receiving input energy;

a conical horn portion tapering outwardly from the base to an output aperture of the feed horn;

a plurality of L-shaped compensating conductors disposed symmetrically about a longitudinal axis of the feed horn and extending inwardly from the output aperture a predetermined distance toward the base and then radially outwards a predetermined distance away from the axis toward the conical horn portion, and disposed at a predetermined angle relative to the axis, which angle is defined by an cone whose apex is the same as the apex of the feed horn;

a nonconducting support structure attached to the feed horn and the plurality of compensating conductors for supporting the conductors within the feed horn; and a matching member having a circular aperture of predetermined size disposed therein disposed between the base and the compensating conductors for eliminating unwanted reflections created by the compensating conductors and the support structure.

6. The compensated feed horn of claim 5 wherein said nonconducting support structure comprises a plastic support structure.

7. The compensated feed horn of claim 5 wherein said matching member comprises a dielectric matching ring.

8. The compensated feed horn of claim 6 wherein said matching member comprises a dielectric matching ring.

9. A compensator for use in an antenna feed horn comprising a base having an input aperture and a horn portion extending from the base to an output aperture, which compensator reduces cross polarized components of circular polarized radiation emanating from the feed horn when it is driven with circularly polarized energy, said compensator comprising:

a plurality of L-shaped compensating conductors disposed symmetrically about a longitudinal axis of the feed horn and extending inwardly from its output aperture a predetermined distance toward the base and then radially outwards a predetermined distance away from the axis toward the horn portion, and disposed at a predetermined angle relative to the axis, which angle is defined by an cone whose apex is the same as the apex of the conical feed horn;

a nonconducting support structure attached to the feed horn and to the plurality of compensating conductors for supporting the conductors within the feed horn; and a dielectric member having an aperture of predetermined size disposed between the base and the compensating conductors for eliminating unwanted energy reflection created by the compensating conductors and the support structure.

10. A compensated feed horn which radiates reduced amounts of cross polarized components of circular polarized radiation when it is driven with circularly polarized energy, said feed horn comprising:

a base having an input aperture disposed therein for receiving circularly polarized input energy;

a horn portion which tapers outwardly from the base to an output aperture of the feed horn;

a plurality of L-shaped compensating conductors disposed symmetrically about a longitudinal axis of the feed horn and extending inwardly from the output aperture a predetermined distance toward the base and then a predetermined distance away from the axis toward the horn portion, and disposed at a predetermined angle relative to the axis;

a nonconducting support structure attached to the feed horn and the plurality of compensating conductors for supporting the conductors within the feed horn; and a dielectric member having an aperture of predetermined size disposed therein disposed between the base and the compensating conductors for eliminating unwanted energy reflection created by the compensating conductors and the support structure.

11. A compensator for use in a microwave feed horn comprising a base having an input aperture and a horn portion extending from the base to an output aperture, which compensator reduces off-axis cross polarized components of circular polarized radiation emanating from the feed horn, said compensator comprising:

a plurality of compensating conductors disposed about a longitudinal axis of the feed horn and exending inwardly from its output aperture a predetermined distance toward the base and then outwards a predetermined distance away from the axis toward the horn portion, and disposed at a predetermined angle relative to the axis;

nonconducting support structure means for supporting the plurality of compensating conductors within the feed horn; and a matching member disposed between the base and the compensating conductors for eliminating unwanted reflections created by the compensating conductors.

12. A compensated microwave feed horn which reduces cross polarized components of circular polarized radiation emanating therefrom, said feed horn comprising:

a base comprising an input aperture disposed therein for receiving input energy;

a horn portion tapering outwardly from the base to an output aperture of the feed horn;

a plurality of compensating conductors disposed about a longitudinal axis of the feed horn and extending inwardly from the output aperture a predetermined distance toward the base and then outwards a predetermined distance away from the axis toward the horn portion, and disposed at a predetermined angle relative to the axis;

nonconducting support structure means for supporting the conductors within the feed horn; and a matching member disposed between the base and the compensating conductors for eliminating unwanted reflections created by the compensating conductors and the support structure.

13. A compensator for use in a microwave feed horn comprising a base having an input aperture and a horn portion extending from the base to an output aperture, said compensator comprising:

a plurality of compensating conductors disposed about a longitudinal axis of the feed horn and extending from its output aperture toward the base and then outwards toward the horn portion, and disposed at a predetermined angle relative to the axis;

nonconducting support structure means for supporting the plurality of compensating conductors within the feed horn; and a matching member disposed in the feed horn for eliminating unwanted reflections created in the feed horn.

14. A compensated microwave feed horn comprising:

a base having an input aperture;

a horn portion tapering outwardly from the base to an output aperture of the feed horn;

a plurality of compensting conductors disposed about a longitudinal axis of the feed horn and extending inwardly from the output apertue and then outwards toward the horn portion, and disposed at a predetermined angle relative to the axis;

nonconducting support structure means for supporting the conductors within the feed horn; and a matching member disposed in the feed horn for eliminating unwanted reflections created in the feed horn.

* * * * *